United States Patent [19]

Fallon et al.

[11] 4,358,983

[45] Nov. 16, 1982

[54] BLAST ENABLED MISSILE DETENT/RELEASE MECHANISM

[75] Inventors: Ray D. Fallon, Thousand Oaks; Richard D. Stubbs, Woodland Hills, both of Calif.

[73] Assignee: Hughes Aircraft Company, Culver City, Calif.

[21] Appl. No.: 973,461

[22] Filed: Dec. 26, 1978

[51] Int. Cl.[3] ..... F41F 3/04

[52] U.S. Cl. ..... 89/1.806; 89/1.807

[58] Field of Search ..... 89/1.806, 1.807

[56] References Cited

U.S. PATENT DOCUMENTS

| | | | |
|---|---|---|---|
| 2,460,929 | 2/1949 | Goff | 89/1.807 |
| 2,940,363 | 6/1960 | Hamilton et al. | 89/1.806 |
| 3,076,385 | 2/1963 | Bornhöft | 89/1.806 |
| 3,296,929 | 1/1967 | Jacobson | 89/1.806 |
| 3,513,749 | 5/1970 | Magnant | 89/1.807 |
| 3,719,120 | 3/1973 | Elder et al. | 89/1.806 |
| 4,132,150 | 1/1979 | Conn | 89/1.806 |

FOREIGN PATENT DOCUMENTS

| | | | |
|---|---|---|---|
| 592861 | 11/1977 | Switzerland | 89/1.806 |

*Primary Examiner*—Richard E. Schafer
*Assistant Examiner*—Edward F. Miles
*Attorney, Agent, or Firm*—Lewis B. Sternfels; W. H. MacAllister

[57] ABSTRACT

A missile or rocket detent and positive release mechanism, actuated by the rocket's thrustor, is mounted on the outside of a rocket launcher tube. A notched-end (52) of a spring-loaded lever (50) extends into the launch tube for positively locking a rocket (10) into place. One end of a sear (60) extends over the spring lever for maintaining the lever in its locked position. A toggle lever (44) is pivotally connected to the other end of the sear and extends into the blast region of the rocket, whose high speed exhaust gasses cause it to be pivoted out of the way, to withdraw the sear from the spring loaded lever, and thus to permit release of the rocket.

12 Claims, 5 Drawing Figures

BLAST ENABLED MISSILE DETENT/RELEASE MECHANISM

BACKGROUND OF THE INVENTION

1. Field of the Invention

The invention relates generally to rocket and missile launchers and, in particular, to a positive detent and release mechanism for a rocket propelled missile.

2. Description of the Prior Art

Rocket launchers are well known in the prior art. Each generally consists of a light weight, relatively thin aluminum launch tube having a diameter which is slightly larger than that of the body of the rocket. The launch tube may also be made of a composite material such as fiber glass or resin impregnated paper. The length of the launch tube is usually greater than that of the rocket. A plurality of launch tubes may be assembled together into a pod which is carried on pylons beneath an airplane's wing or along the fuselage of a helicopter. The firing sequence of a group of rockets is generally one at a time so that the total heat generated by the rocket motors within the pod at one time is kept at a minimum. Also, rocket collisions in free flight are avoided. Alternatively, the missile or rocket may be launched from a rail.

In addition to the standard launcher having a flat face, an experimental supersonic rocket launcher has been fabricated for an F-4 Phantom jet which carries eighteen 2.75-inch folding fin aircraft rockets in individual aluminum launch tubes. The individual launch tubes are spaced symmetrically about a central axis. The launcher consists of three major sections. The forward section contains 18 aluminum launch tubes and provides the basic aerodynamic shape and main structural integrity and strength of the launcher. The middle section contains the electrical firing circuitry and rocket retention mechanisms. The tail section of the launcher is a hollow aerodynamic fairing designed to reduce base drag. The launcher features a lightweight composite structure consisting of a foam encapsulated, integrally bonded aluminum tube matrix in combination with a glass fiber reinforced epoxy laminated structural system covered by an outer skin.

It is important that each of the rockets be fired properly and that each exits its respective launch tube without damaging it. In practice it has been acceptable to have a few launch tubes in a pod that are inoperative. If more than these launch tubes should be damaged in firing their cargo, the entire launcher would have to be discarded. Thus, every damaged launch tube is a potentially expensive occurrence.

The rocket, as configured for the field, has the rear stabilizer fins folded backwards so that they extend beyond the rear of the rocket body and their leading edges lie within the projection of the body's circumference. After folding the fins, a rectangular plastic fin retainer is attached to the fin tips to keep them in place. A circular metal contact disc is disposed on the face of the plastic retainer facing away from the fins. An electrical wire connects the contact disc with the firing mechanism within the rocket. The fire signal is applied to the rocket through the metal contact disc. The body of the rocket is "grounded" through the retainer's contact with the rocket.

In loading the rocket into its launch tube, referred to as "up loading", the rocket is slid into its launch tube until a circumferential ridge at the aft portion of the rocket body engages the detent/release mechanism. The contact disc at the same time engages an igniter contact arm through which the "fire" signal is conducted to the rocket motors. Up-loading of most prior art launch tubes requires a substantial amount of force. For example, it may require a 250 pound force to release the rocket from the launch tube and, conversely, it may require that same amount to engage the detent, depending upon the configuration of the particular release mechanism. It is not unusual to see technicians literally flinging the rockets into the launch tube in order to engage the detent mechanism.

In flying a mission, the rocket detent is required to perform several functions. It must keep the rocket in place at all times irrespective of the craft's attitude and the forces which are exerted on it. For instance, during aerobatic maneuvers and during landings, great forces and stresses are placed on the detent mechanism which is expected to restrain the rocket. In carrier landings where arresting lines and hooks are used to stop a jet, it has been calculated that forces in excess of 9 g's are generated, which are also exerted on the detent mechanism. In catapult take-offs, forces of 6 g's have been calculated. If the detent mechanism malfunctions, the rocket could be separated from its launch tube, possibly causing extensive damage to the craft, or persons and equipment near the craft.

When the rocket motor is fired, it is expected that within a predetermined time, or within a predetermined thrust force of the rocket, the release mechanism will be actuated and the rocket will exit the launch tube. If the release mechanism should malfunction and the rocket is not released, called "hangfire", the launch pod could sustain substantial damage as well as possible damage to the aircraft structure. A hangfire in a helicopter launched rocket is especially dangerous because handling characteristics are more easily affected by outside forces due to the lighter mass of the helicopter. If a rocket fails to exit the launch tube within a few seconds of the thrustor being fired, the launch tube may sustain substantial fire damage possibly making it inoperable for future use. Certain materials, such as fiber glass, composite or aluminum within the firing end of the rocket launcher pod cannot withstand continuous temperatures associated with the rocket motor propellant burning characteristics without damage. In addition, ejected fragments from the failed tube may present a hazard to the aircraft. Notwithstanding the fact that most rocket pods are disposable armament, if a sufficient number of launch tubes are damaged due to the rocket's flaming within the tube, the pods may have to be discarded prematurely. Depending upon the number of launch tubes in a particular pod, a certain number of damaged launch tubes may be acceptable. However, when the number of damaged launch tubes exceeds a predetermined percentage of the total, then the entire pod must be discarded. Generally, these otherwise disposable rocket launch pods may be used almost indefinitely so long as the rockets and detent mechanism do not malfunction. Thus, many firings may be obtained from an individual pod.

The fin retainer is blown away by the action of the thrustors and as the rocket exits its launch tube, the folded back fins are deployed to their proper positions within a few feet of the rocket leaving the tube. Surprising results were found in tests conducted on a number of launch tubes using prior art release mechanisms, and it was found that the release forces required for each succeeding test tended to be substantially lower than the preceeding test. In other words, each subsequent rocket launch occurred earlier than the last, due to the mechanism becoming weakened from the prior firing. Eventually, the launch tubes, become unusable due to the release mechanisms being ineffective and dangerous.

A prior art detent mechanism used extensively provides a longitudinal restraint to a rocket by means of a notched detent member which interfaces with the circumferential ridge aft of the rocket motor bourrelet. The detent member is held down in place, against the circumferential ridge, by a leaf spring to preclude inadvertant release due to vibration or shock loads. At launch, the detent is released by the rocket motor thrust overriding the detent restraining force. In the examination of this prior art detent mechanism after firings, it was found that the detent material had undergone permanent deformation such that the notch had become elongated until only a small ridge was left. This ridge was found to be unable to properly restrain future loads. Another shortcoming of such prior art detent mechanisms is that the release depends upon columnar bending forces which are essentially unpredictable. In some pod configurations, it is generally required that a rocket be released by forces in the range of 175 to 280 pounds. However, in several tests it was found that it took more than the maximum prescribed force to release the rocket. It appears that the erratic forces required to release the rocket is an inherent characteristic of that prior art detent. In addition, many factors increase the variation. Such excessive forces could result in damage to the pod, the mounting structure or the aircraft.

OBJECTS OF THE INVENTION

Accordingly, it is a primary object of the present invention to provide a simplified, improved, economical, and reliable detent/release mechanism.

It is another object of the present invention to provide a release mechanism having a predetermined constant release force.

It is still another object of the present invention to provide an integrated detent/release-igniter contact arm mechanism.

It is yet another object of the present invention to provide blast actuated positive release action for a missile.

It is another object of the present invention to provide an automatic rocket release mechanism.

It is still another object of the present invention to provide a rocket launch tube which may be armed from either end.

It is yet another object of the present invention to provide a detent mechanism permitting a missile to be easily loaded.

SUMMARY OF THE INVENTION

In accordance with the foregoing, an automatic blast enabled release detent includes a spring-loaded detent which is adapted to be clamped onto a missile. One end of a sear locks the detent in place until the sear is withdrawn. A second lever is pivotably connected to the second end of the sear. A portion of the second lever extends into the path of the exhaust gasses which pivots the second lever and causes the sear to be withdrawn, the detent to be released, and the rocket to be unclamped.

DETAILED DESCRIPTION OF THE DRAWINGS

Figure 1:
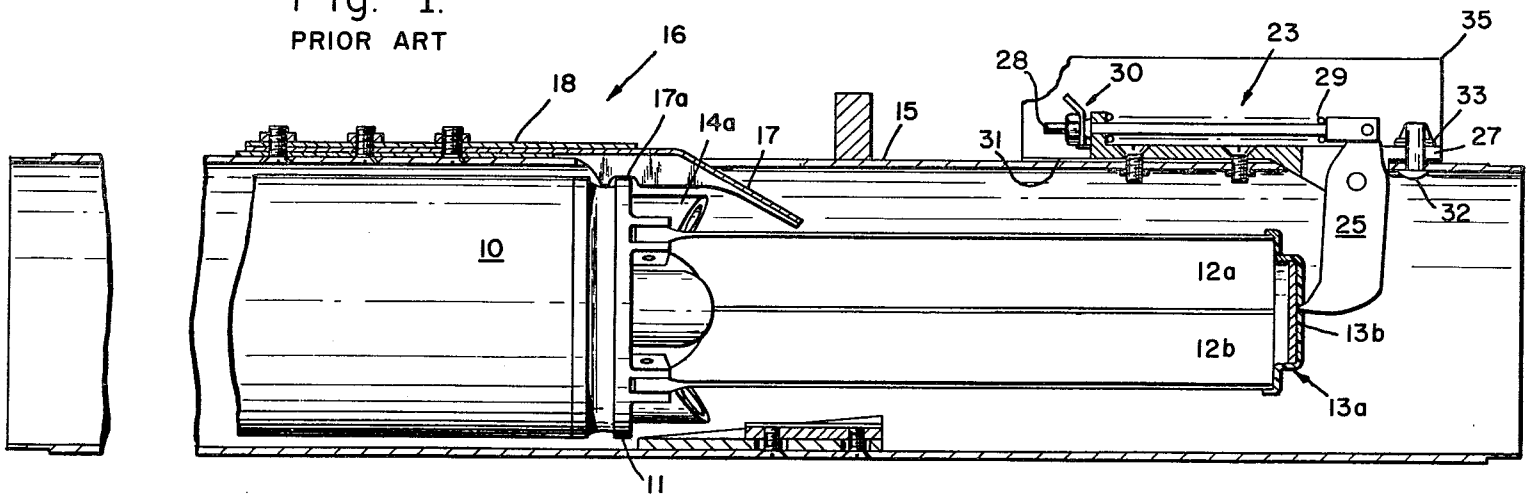
Fig. 1. PRIOR ART
FIG. 1 is a cross-sectional side view of a rocket in a launch tube having a prior art detent/release mechanism and a contact igniter arm assembly.

Referring specifically to FIG. 1, a prior art detent/release mechanism and a contact igniter arm mechanism are illustrated as mounted onto a rocket launch tube. A rocket 10 is up-loaded into a launch tube 15 through the forward end of the tube 15 after the four fins 12*a*–12*d* have been folded backward toward the aft end of the rocket 10. A plastic fin retainer 13*a*, having a contact disc 13*b*, is attached to the fins' ends. The contact disc 13*b* is connected to the rocket motors via an electrical wire (not shown).

The detent/release mechanism 16 includes a detent lever 17 which extends through an opening in the launch tube, and the notch 17*a* engages ridge 11 extending from the circumference of the rocket for securing the rocket 10 in place. A preloading leaf spring 18 is disposed on top of the lever 17 and the two are fastened to the launch tube 15 by rivets or screws. The rocket's thrust must overcome the combined forces of the leaf spring 18 and the detent lever 17 to release the rocket 10 as illustrated in FIG. 2 below.

Figure 2:
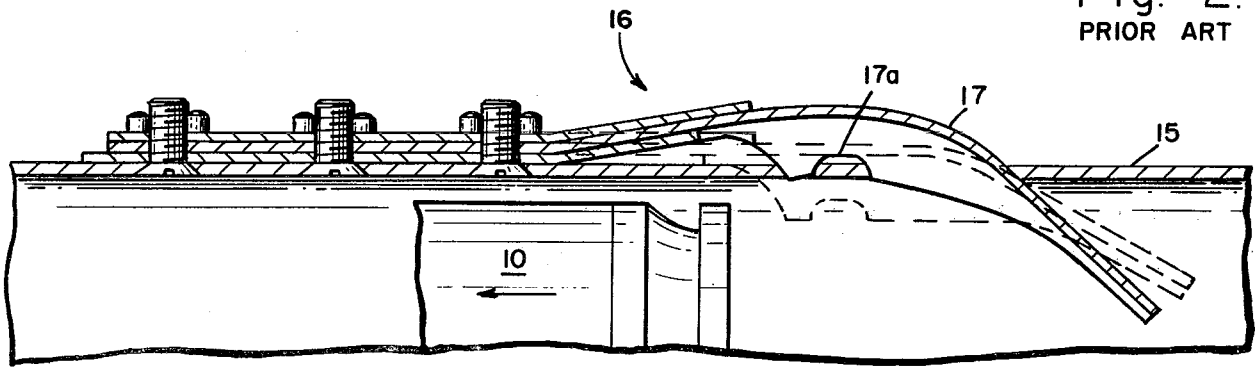
Fig. 2. PRIOR ART
FIG. 2 is an exploded view of the releasing motion of the prior art device according to FIG. 1.

Referring briefly to FIG. 2, the detent mechanism 16 is illustrated in its rocket-releasing configuration. The detent lever 17 is shown in a bowed configuration as it is being subjected to elastic column bending forces due to the rocket's thrust. Column bending forces are unstable and often unpredictable. Thus, it is difficult to accurately predetermine release forces. Repeated flexion in the manner just described has often resulted in fatique failure and fracture of the detent lever 17 just forward of the notch 17*a*. The dashed lines represent the position of the detent lever 17 when the rocket 10 is in place.

As shown in FIG. 1, the igniter arm assembly 23 is a separate unit from the detent/release mechanism 16. An igniter arm 25 extends through the aft end of the launch tube 15 and pivots on a mounting block 27. The lower end of the igniter arm 25 is designed to make physical and electrical contact with the contact disc 13*b* for conducting the fire signal. The upper end of the igniter arm 25 is spring loaded via a push rod 28 and a compression spring 29. A spade electrical lug 30 is attached onto the threaded end of the push rod 28 for receiving the fire signal. To prevent the fire signal from shorting to the launch tube 15, a thin sheet of dielectric material 31 is interposed between the mounting block 27 and the tube 15. The screw 32 securing the mounting block 27 is also insulated by a nylon washer 33. The rivets at the forward end of the mounting block 27 are also insulated. Thus, the fire signal is applied to the entire igniter contact assembly 23 without shorting to ground. A triangular-shaped metal housing 35 is disposed about the igniter arm assembly 23 and is not in electrical contact therewith.

Due to the igniter arm 25 being permanently fastened within the tube 15, the rocket may only be up and down loaded from the forward end of the launch tube 15. Also, due to the design of the detent lever 17, the tab extending beyond the notch 17*a* must be pried up with a special pry bar to release the rocket 10 when it is being down-loaded.

Figure 3:
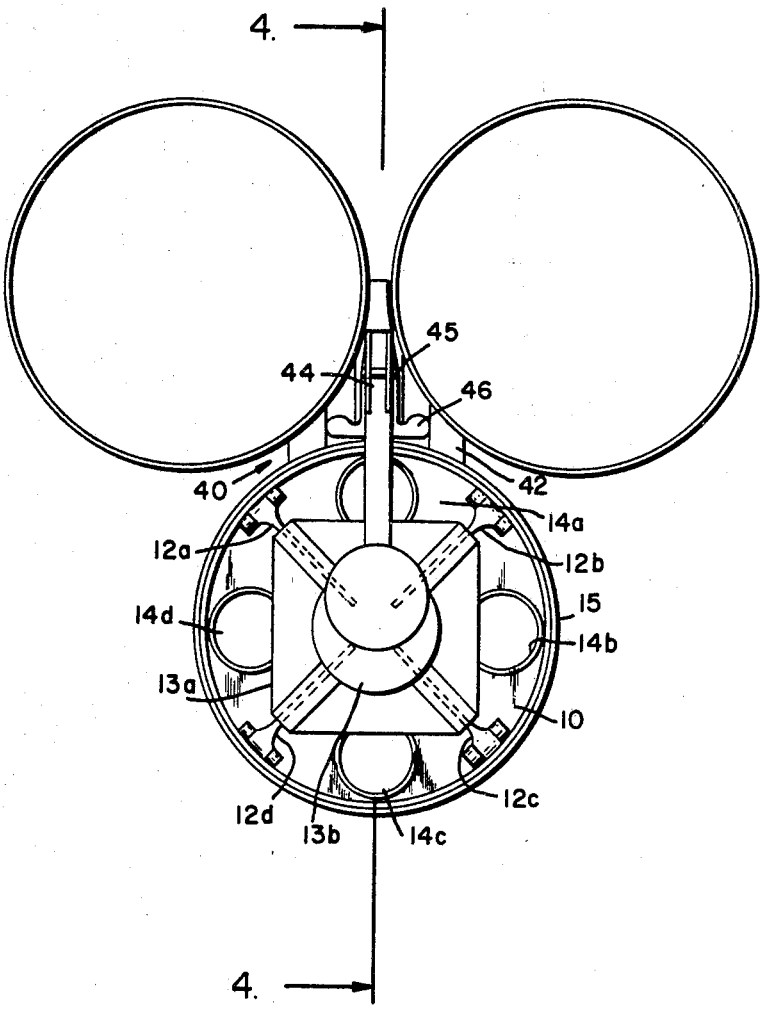
FIG. 3 is an end view of a rocket detent according to the present invention mounted on a launch tube within a matrix.
Figure 4:
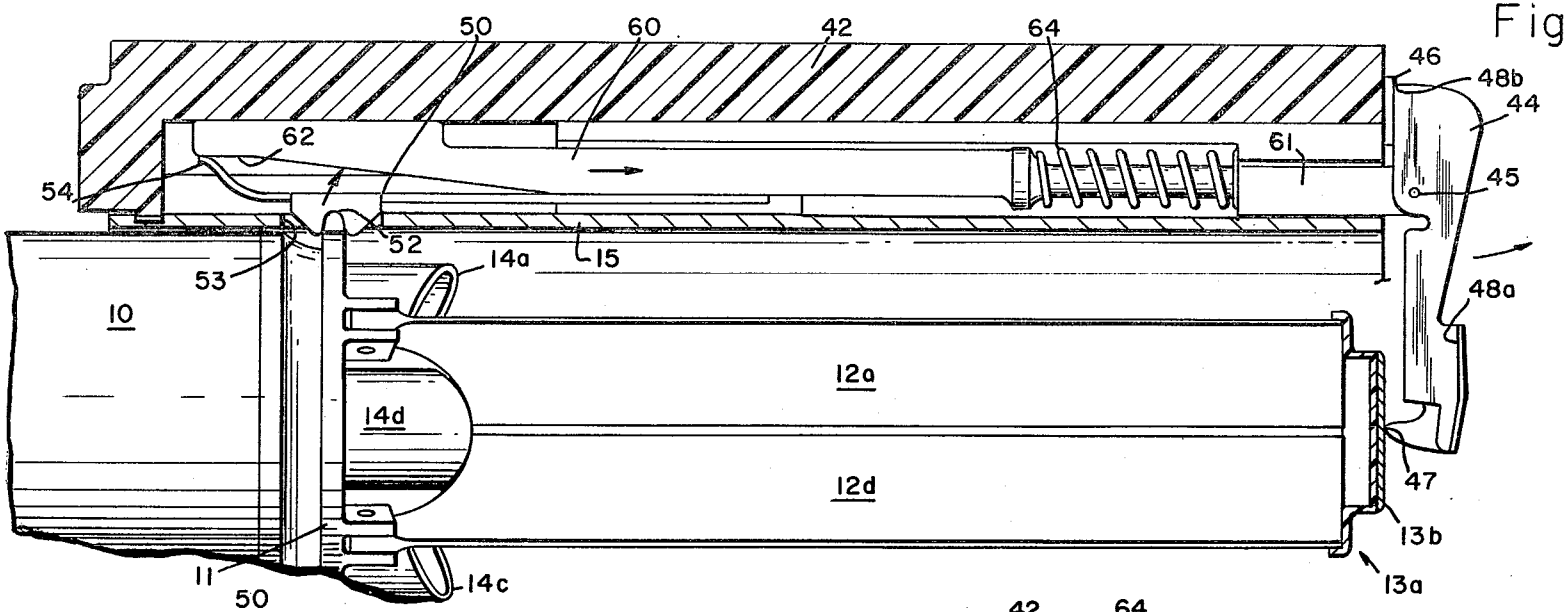
FIG. 4 is a cross-sectional side view of a rocket detent device according to the present invention prior to release.
Figure 5:
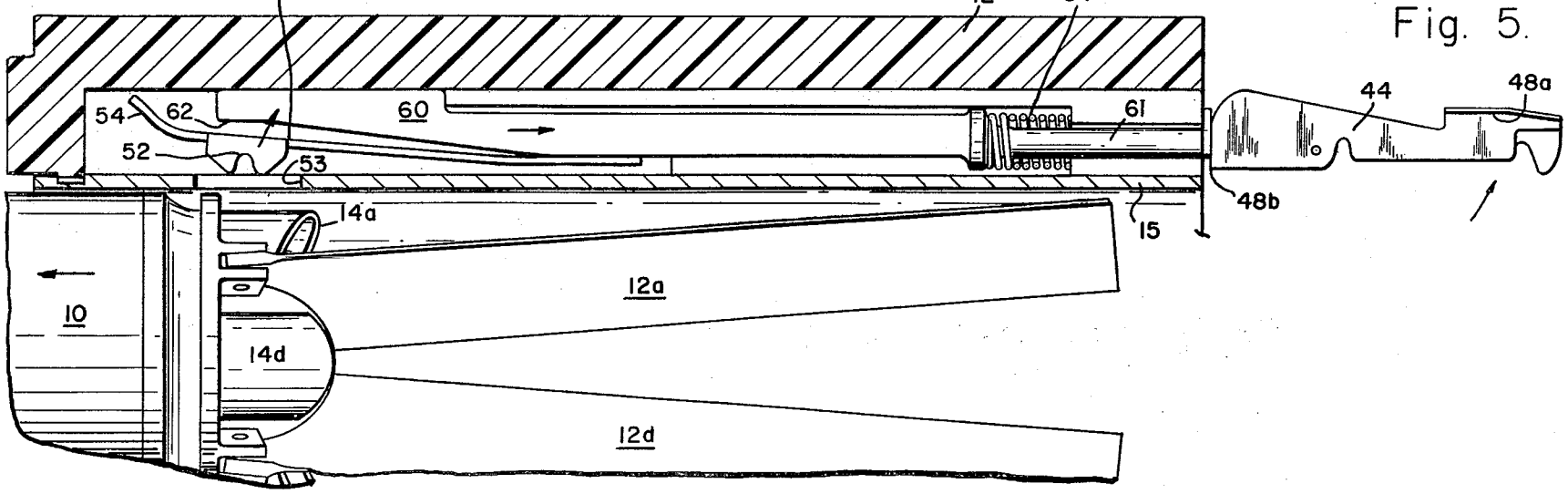
FIG. 5 is a cross-sectional side view of the invention similar to that of FIG. 4 showing release of the rocket by its blast.

The items and components depicted in FIGS. 3–5, which are the same or perform the equivalent function as items and components of FIG. 1, are identified by the same reference designation numerals as in FIG. 1.

Referring more specifically to FIG. 3, the end view of the invention 40 illustrates a housing 42 mounted onto the top of a launch tube 15. The housing 42 has a triangular shape to permit a plurality of launch tubes 15 to be assembled together into a matrix. The missile 10 is shown in place preparatory to being fired. The fin retainer 13*a* is clamped onto the fins 12*a*–12*d* to prevent them from being dislodged and damaged due to excessive vibrations. The central contact disc 13*b* receives the fire signal from an igniter contact arm or toggle lever 44. The igniter arm 44 is mounted onto the end of a connector arm 61 on a slide or sear 60 (see FIG. 4) via a pivot point 45. A spring 64 coupled to the sear exerts a bias so that pressure of the spring loaded connector arm will maintain electrical continuity between the igniter contact arm 44 and a contact plate 46 mounted at the end of the housing 42. The contact plate 46 behind the igniter arm 44 receives the fire signal on an electrical wire (not shown). Preferably, the housing 42 is made of a dielectric material so that the metal contact plate 46 can be mounted directly to it without insulators to prevent shorting the fire signal to ground.

The thrust of the exhaust gases from the rocket exhaust nozzle 14*a* pushes against the igniter arm 44 and rotates it on its pivot point 45 out of the way, thereby disengaging the positive detent described below relative to FIG. 4.

The invention is described in greater detail in FIG. 4 which illustrates a partial cross-sectional side view of the detent/release mechanism 40 along the plane 4–4 in FIG. 3 as it engages the rocket 10 in a launch tube 15.

The dielectric housing 42 mounts all the various arms and levers used in practicing the invention. Specifically, a detent lever 50, e.g., of stainless steel spring stock, has a cantilevered connection, such as by riveting, to the housing at one end, and a notched detent member 52 at its free end. The lever is normally biased towards the launch tube 15 so that detent 52 extends into the launch tube through a hole 53 therein for a clamping engagement with the rachet at its circumferencial ridge 11. A spring tab 54 and an upwardly tapered surface 62 respectively terminate the lever 50 and the sear 60. The tab 54 forms a resilient connection between the lever's and the sear's complimentary mating surfaces and is so positioned behind the detent member 52 that, if the linkage between the ignitor arm 44 and the sear fails to move the sear from the detent lever in response to the thrust of the rocket, the thrust will nevertheless override the spring force of the detent lever's spring tab 54 to permit release of the rocket from the launch tube. The lever 50 may be made to exert a small, 10–20 pound force as it locks on the rocket 10. An electrical lug (not shown) is mounted onto the top of the housing 42 by one of the mounting rivets for providing electrical continuity to the rocket body through the detent lever 50.

A return spring, shown as a compression spring 64, is disposed about the sear's connecting arm 61 and against the housing 42. Its compression force is determined by the thrust release force of the rocket and the blast catching area of the igniter arm 44. The sear 60 is preferably made of a dielectric material in order that the ground potential of the detent lever 50 be isolated from the fire signal applied to the igniter arm 44.

The igniter arm 44 is connected to the sear's connecting arm 61 at the pivot point 45. As described above, the igniter arm 44 rests against a contact plate 46 which receives the fire signal. The igniter arm 44 has a protruding contact point 47 at its lower end for making electrical contact to the rocket's fire signal contact disc 13*b*.

The structure of the igniter arm 44 is briefly described in greater detail. The circular member or surface 48*a* receives the rocket blast for pivoting the igniter arm 44. Depending upon the thrust forces developed by a particular rocket, it may be necessary to vary the size of the surface 48*a* from that depicted in the figure. For example, a low thrust rocket may require an igniter arm having a greater front surface and, conversely, for a high thrust rocket. The upper leading surface 48*b* has a small radius, such as 0.13 inch, to permit the igniter arm 44 to slide smoothly on the contact plate 46 as it pivots on its pivot point 45.

FIG. 5 illustrates the rocket 10 being released from the launch tube 15. The fire signal is applied to the rocket's thrustor through the igniter arm 44 and the contact disc 13*b*. After the motor fires, it develops sufficient thrust to rotate the igniter arm 44 out of the way. The rocket exhaust flow consistently produces a static pressure in the launch tube in the 25 to 50 psi range which when stagnated against the contact arm, develops a total pressure of 100 to 300 psi (or 25 to 150 pounds actuation force depending on selected contact frontal area and the thrust of a particular rocket). As the sear 60 is slid or drawn rearward due to the toggle action of the arm 44, the detent lever 50 is unlocked, allowing the thrust force of the rocket to easily overcome any remaining resistance of the lever 50. The rocket 10 is thereupon free to exit the launch tube 15. Thus, the invention provides a positive release.

One of the novel features of the present invention is that the igniter arm 44 is rotated out of the way of the rocket blast as soon as sufficient thrust has been developed to overcome the bias of the compression spring 64 so that, unlike most prior art igniter arms, it is subjected to fewer corrosive gases. Thus, its life is prolonged which, in turn, prolongs the life of the entire rocket pod assembly. Up-loading of the rocket or missile is greatly simplified over the prior art devices. To load the rocket into the launch tube, one need only flip the contact igniter arm 44 up and out of the way. Thence, the rocket 10 may be loaded from either fore or aft. The amount of force required to engage the detent is drastically reduced from the previous 100+ pounds to a mere 15 or 20 lbs. The down loading capability of the rocket launcher has been greatly improved and simplified. It only requires a relatively small force of the fingers to flip the arm 44 thereby disengaging the rocket 10. Thus, the blind probing with a special pry bar of the prior art has been eliminated.

Although the invention has been shown and described with respect to particular embodiments, nonetheless, certain changes and modifications by one skilled in the art to which the invention pertains are deemed within the purview of the invention.

We claim:

1. A blast actuated release/detent mechanism for a missle capable of producing a thrusting blast, comprising:

a lever moveable from a first to a second position for restrainingly engaging said missile;

a slidable member engageable with said lever for maintaining said lever in said second, missile-engaging position;

a blast-actuated member pivotably connected to said slidable member, and extendable to a first position into the blast path of said missile, and pivotable to a second position in response to the blast for sliding said sliding member from its engagement with, to disengagement from, said lever.

2. A mechanism according to claim 1, further comprising a spring biasing said slidable member into its engagement with said lever and providing a predetermined resistance to pivoting of said blast-actuated member between its first and second positions.

3. A blast-actuated missile release mechanism comprising:

a launch tube supporting a missile;

a lever having a resilient connection with said launch tube and normally spring-biased by said resilient connection to a first position and moveable to a second position against the bias of said resilient connection;

means associated with said lever and engageable with, and disengageable from, said missile respectively in the lever's first and second positions for placing said missile into respective restraining engagement with, and releasing disengagement from, said tube;

a slidable member alternately engageable with, and disengageable from, said lever respectively to maintain both said lever in its first position and said missile in its restraining engagement with said tube, and to allow both said lever to be moved to its second position and said missile into its releasing disengagement from said tube;

an arm pivoted on said slidable member and placed thereby in first and second engageable positions with said launch tube and, when in its first engageable position, maintaining said slideable member in engagement with said lever and, when in its second engageable position, permitting disengagement of said slideable member from said lever, said arm including a surface which, when in said arm's first engageable position, is positionable in said launch tube and exposable to a blast from said missile and which, upon exposure to the blast, pivots said arm to its second engageable position.

4. A mechanism according to claim 3 further including a yieldable interengagement between said slidable member and said lever, in which the restraining force of said lever-associated means acting to place said missile into its restraining engagement with said tube is insufficient to prevent release of said missile when subjected to the blast, in the event of failure of said arm to move to its second engageable position in the presence of the blast.

5. A mechanism according to claim 3 wherein said lever is of spring stock and cantilevered to said launch tube.

6. A mechanism according to claim 5 wherein said lever's engageable-disengageable means is a notch.

7. A mechanism according to claim 3 wherein said slidable member is movable in a first direction and said arm is movable generally in an orthogonal direction thereto.

8. A mechanism according to claim 3 further including means coupled between said slidable member and said launch tube for biasing said slidable member and said lever into engagement and for providing a predetermined resistance to pivoting of said arm between its first and second engageable positions.

9. A missile launcher comprising:

a support slidably supporting a rocket propelled missile;

a cantilevered lever of spring stock having an engaging surface and a detent displaced therefrom and releasably engaging said missile and restraining said missile against sliding movement along said support;

an arrangement for igniting the propellant of said rocket;

a spring-loaded toggle linkage including a movable spring-loaded sear having an engaging surface which is complementarily engageable with said engageable surface of said cantilevered lever, and a rocket blast-actuated toggle lever rotatably connected to said spring-loaded sear, said toggle lever having a first toggle position in the path of a gas blast from said rocket and having a second toggle position when subjected to the rocket gas blast to move sequentially said spring-loaded sear, said cantilevered lever and said spring-loaded sear into said second toggle position, to displace said complimentary engaging surfaces and to permit the release of said movable restraining member from said missile.

10. In a missile launcher having a support slidably supporting a rocket propelled missile, a movable restraining member releasably engaging said missile and restraining said missile against sliding movement along said support, and an arrangement for igniting the propellant of said rocket, the improvement comprising a movable spring-loaded sear engageable with said movable restraining member, said sear constituting means for maintaining said restraining member in restraining engagement with said missle; and a rocket blast-actuated toggle lever rotatably connected to said spring-loaded sear, said toggle lever having a first toggle position in the path of a gas blast from said rocket and having a second toggle position when subjected to the rocket gas blast in which said spring-loaded sear moves said restraining member for releasing said movable restraining member from said missile and thereby said missile from said support.

11. A missile launcher according to claim 4, in which said spring-loaded sear and said movable restraining member respectively have complimentary engaging surfaces, and said spring-loaded sear is moved longitudinally by said toggle lever into said second toggle position to displace said complimentary engaging surfaces and to permit the release of said movable restraining member from said missile.

12. A missile launcher according to claim 11, further including a resilient connection between said complimentary engaging surfaces exerting a force on said detent to move said detent into restraining engagement with said missile, and in which the spring restraining force acting on said detent to engage said missile is insufficient to prevent missile release when subjected to the rocket thrust, in the event of failure of said toggle lever to move to said second toggle position in the presence of the rocket blast.

* * * * *